US007591609B2

(12) United States Patent
Beyers

(10) Patent No.: US 7,591,609 B2
(45) Date of Patent: Sep. 22, 2009

(54) METHOD AND APPARATUS FOR LAYING REINFORCING BARS

(76) Inventor: Leonard Francis Beyers, 12 Evesham Court, Baulkham Hills, Sydney, New South Wales 2153 (AU)

( * ) Notice: Subject to any disclaimer, the term of this patent is extended or adjusted under 35 U.S.C. 154(b) by 371 days.

(21) Appl. No.: 10/576,041

(22) PCT Filed: Oct. 29, 2004

(86) PCT No.: PCT/AU2004/001504

§ 371 (c)(1),
(2), (4) Date: Dec. 22, 2006

(87) PCT Pub. No.: WO2005/042849

PCT Pub. Date: May 12, 2005

(65) Prior Publication Data

US 2007/0110518 A1 May 17, 2007

(30) Foreign Application Priority Data

Oct. 31, 2003 (AU) ..... 2003906049

(51) Int. Cl.
*E01C 23/04* (2006.01)

(52) U.S. Cl. ..... 404/100

(58) Field of Classification Search ..... 404/100
See application file for complete search history.

(56) References Cited

U.S. PATENT DOCUMENTS

| | | | | |
|---|---|---|---|---|
| 2,368,074 | A * | 1/1945 | Walton | 435/66 |
| 2,996,963 | A * | 8/1961 | Stultz et al. | 404/100 |
| 3,361,043 | A * | 1/1968 | Beeson | 404/100 |
| 3,632,054 | A * | 1/1972 | Heppelmann et al. | 242/557 |
| 3,814,144 | A * | 6/1974 | Spencer | 140/107 |
| 5,009,545 | A * | 4/1991 | Coleman et al. | 404/100 |
| 5,135,333 | A * | 8/1992 | Guntert et al. | 404/100 |
| 7,100,642 | B2 * | 9/2006 | Taboga | 140/7 |

FOREIGN PATENT DOCUMENTS

| | | |
|---|---|---|
| DE | 41 22 136 A1 | 1/1993 |
| EP | 0488 855 A1 | 6/1992 |
| GB | 1 403 049 | 8/1975 |
| GB | 1 499 012 | 1/1978 |
| WO | WO 92/12294 A1 | 7/1992 |

* cited by examiner

*Primary Examiner*—Raymond W Addie
(74) *Attorney, Agent, or Firm*—Stinson Morrison Hecker LLP

(57) ABSTRACT

A method and apparatus for assembling and depositing a reinforcement mesh on a prepared surface, wherein a mobile workstation is provided which includes an elevated support arrangement, the workstation being moveable in a first direction. The workstation includes a series of longitudinal reinforcement rods on or above said support arrangement, said longitudinal reinforcement bars being spaced apart and aligned generally parallel to said first direction. A roll of transverse reinforcing rods is supported on said workstation and adapted to be unrolled to form a series of spaced apart reinforcement rods aligned generally transverse to said first direction. The transverse rods are connected to at least one of said longitudinal rods to form an orthogonal reinforcement mesh on said mobile workstation and as the workstation in said first direction, said mesh is deposited on said prepared surface.

31 Claims, 5 Drawing Sheets

METHOD AND APPARATUS FOR LAYING REINFORCING BARS

FIELD OF THE INVENTION

The present invention relates to a method and an apparatus for assembling reinforcement. The present invention particularly relates to a method and apparatus for assembling and laying reinforcement, especially reinforcement used in the construction of roads, most especially reinforced concrete roads.

BACKGROUND OF THE INVENTION

Reinforced concrete roads conventionally comprise a foundation layer, the so-called sub-base, usually of un-reinforced concrete, and the pavement or so-called base slab, which is reinforced, and is poured directly onto the sub-base.

Typically, the base slab is reinforced by a rectangular grid of steel reinforcing rods comprising a plurality of spaced apart longitudinal rods extending in the direction of the road and a plurality of spaced apart transverse rods extending athwart the longitudinal rods and tied thereto at each crossing point in the mesh. The longitudinal rods are individually fairly short, say 12 metres long, but successive longitudinal rods are spliced together, that is to say, overlapped and tied to each other, to form a continuous ribbon of mesh extending along the road. That ribbon is supported from the sub-base by plastic or other bar chairs to ensure that the reinforcement is at the correct altitude in the finished pavement.

Hitherto, the mesh ribbon has been formed in-situ by a team of steel fixers by hand. This not only involves manhandling all the steel into place and tying the individual rods together while stooped over double, but also requires the preparatory steps of marking the edge of the pavement on the base-base with a chalk line and spot marking the location of the individual transverse rods with paint to ensure that the fixers install the reinforcement to specification. The work is laborious and time consuming. Typically a team of twelve workers can put the reinforcement in place for 200 to 250 meters of two lane pavement per day.

In Australian patent no. 752 385 issued in the name of the present inventor, the entire contents of which are herein incorporated by way of cross-reference, a mobile workstation is disclosed for assembling and laying of pavement reinforcing bars. The mobile workstation has a wheeled chassis adapted to travel a route along which the pavement is to be laid. The mobile workstation carries longitudinal guide and spacing means that is positioned to receive longitudinal reinforcing rods and to space the longitudinal reinforcing rods apart from each other in a transverse direction. The mobile workstation also includes an open topped magazine for holding a quantity of transverse reinforcing rods. In use, the longitudinal reinforcing rods are positioned in the longitudinal rod guide and spacing means and travel over the open-topped magazine. The transverse rods in the open topped magazine are connected one at a time to the longitudinal rods to form a reinforcing mesh. The reinforcing mesh then slides over an apron at the rear of the mobile workstation and the mesh is deposited behind the chassis as the chassis moves ahead.

The mobile workstation described in Australian patent no. 752 385 has resulted in increases in production of between 60% and 100% when compared with conventional methods for laying and typing pavement reinforcement.

Another recent development in laying and assembling reinforcement involves the use of BAMTEC technology. This technology connects a number of reinforcing bars together by welding each bar to flexible steel straps at desired spacing. The thus-connected bars are then rolled up into rolls. When it is time to install the reinforcement, the rolls of reinforcing bars are placed at an appropriate position and simply unrolled. Thus, installation is very quick. Moreover, the spacing and the thickness of the reinforcing rods can be determined for each application using appropriate design criteria and the reinforcing rolls utilising the required rod thickness and spacing can be pre-assembled at a factory for subsequent delivery to the site. BAMTEC is a registered trade marks of Bam AG.

Any discussion of documents, publications, acts, devices, substances, articles, materials or the like which is included in the present specification has been done so for the sole purpose so as to provide a contextual basis for the present invention. Any such discussions are not to be understood as admission of subject matter which forms the prior art base, or any part of the common general knowledge of the relevant technical field in relation to the technical field of the present invention to which it extended at the priority date or dates of the present invention.

SUMMARY OF THE INVENTION

In a first aspect, the present invention provides a method for assembling and depositing a reinforcement mesh on a prepared surface comprising the steps of:

providing a mobile workstation which includes an elevated support arrangement, the workstation being moveable in a first direction;

positioning a series of longitudinal reinforcement rods on or above said support arrangement, said longitudinal reinforcement bars being spaced apart and aligned generally parallel to said first direction;

providing a roll of transverse reinforcing rods supported on said workstation and adapted to be unrolled to form a series of spaced apart reinforcement rods aligned generally transverse to said first direction;

connecting said transverse rods to at least one of said longitudinal rods to form an orthogonal reinforcement mesh on said mobile workstation; and moving the workstation in said first direction to deposit said mesh on said prepared surface.

In a first embodiment of the first aspect, the longitudinal reinforcing rods are provided in the form of a roll of rods connected together by flexible connecting elements, and the longitudinal reinforcing rods being arranged in spaced apart relationship by unrolling the roll. Alternatively, the longitudinal reinforcing rods may be maintained in said spaced apart relationship by a plurality of rollers on said elevated support arrangement. Preferably, the longitudinal reinforcing rods are supported on the support arrangement located to the fore of the roll of transverse reinforcing rods and the replacement longitudinal reinforcing rods are preferably joined to the longitudinal rods which comprise the orthogonal mesh to thereby form a continuous orthogonal mesh on said prepared surface.

In a second embodiment of the first aspect, the method further comprising the step of moving the workstation in said first direction sufficient to draw at least a part of said mesh of said support arrangement to thereby create space on said support arrangement for said replacement longitudinal reinforcing rods.

In a third embodiment of the first aspect, the method further comprising the steps of: providing a second roll of transverse reinforcing rods on the mobile workstation, and progressively joining the reinforcing rods of the second roll of transverse reinforcing rods to one or more of the longitudinal reinforcing rods as the longitudinal reinforcing rods travel over said support arrangement to thereby form a continuous reinforcement mesh.

Preferably the transverse reinforcing rods are joined to the longitudinal reinforcing rods by a welding process. The welding process may be effected manually or effected by an automated welding apparatus. Alternatively, the transverse reinforcing rods may be joined to the longitudinal reinforcing rods by a tying process using a wire, clamp or clip means.

Preferably, the reinforcement mesh is deposited onto spacer members positioned on said prepared surface so as to maintain the reinforcement mesh spaced from the prepared surface at a suitable distance so as to allow the reinforcement mesh to be encased within a slab of concrete. More preferably, the longitudinal and transverse reinforcing rods are sized such that the reinforcement mesh is suitable for reinforcing a concrete roadway.

In a second aspect, the present invention provides a mobile workstation for assembling and depositing a reinforcement mesh on a prepared surface, the workstation comprising:

an elevated support arrangement moveable along the prepared surface in a first direction;

at least one roll holding means for supporting a roll of transverse reinforcing rods, said roll adapted to unroll to form a series of spaced apart reinforcement rods aligned generally transverse to said first direction;

longitudinal reinforcement rod support means for supporting a series of longitudinal reinforcing rods, said series of longitudinal reinforcing rods being in a spaced apart relationship and generally parallel to said first direction;

wherein in use, said transverse rods are connected to at least one of said longitudinal rods to form an orthogonal reinforcement mesh and said workstation moves in said first direction to deposit said mesh on said prepared surface In a first embodiment of the second aspect, the workstation further comprising a chassis that is moveable along the prepared surface. Preferably, the workstation further comprises a plurality of wheels for allowing movement of the workstation along the prepared surface. The workstation may further comprise a set of caterpillar tracks for allowing movement of the workstation along the prepared surface.

In a second embodiment of the second aspect, the workstation further comprises an apron means extending rearwardly of the roll holding means and sloping downwardly toward the prepared surface on which the reinforcement mesh is to be deposited, so as to facilitate deployment of the reinforcement mesh to the prepared surface.

In a third embodiment of the second aspect, the longitudinal reinforcing rod support means comprises a tray, wherein the tray is a portion of the mobile workstation. Alternatively, the longitudinal reinforcing rod support means may comprise a plurality of rollers. The rollers include a circumferential recess, the recess being sized so as to at least partially house the longitudinal reinforcing rods so as to maintain the longitudinal reinforcing rods in said spaced apart relationship.

Preferably, the workstation includes a drive means to motivate the workstation along the prepared surface. Alternatively, the workstation may be motivated by an independent drive means, and the longitudinal rod support means comprises a tray which is integral with the independent drive means.

The at least one roll holding means may be positioned below or above a path of travel of the longitudinal reinforcing rods.

The at least one roll holding means may include one or more rotatable elements on which the at least one roll is supported, the one or more rotatable elements facilitating unrolling of the rolls. The one or more rotatable elements comprises one or more wheel or roller members.

The roll holding means may comprise one or more cradles. Preferably the one or more cradles is semi-circular in section. The one or cradles extend across the mobile workstation. Alternatively, the one or more cradles may be a plurality of narrow cradles positioned transverse relative to each other in a manner so as to support each roll.

Throughout the specification the term "comprise" and variations on this term including "comprising" and "comprises" are to be understood to imply the inclusion of a feature, integer, step or element, and not exclude other features, integers, steps or elements.

BRIEF DESCRIPTION OF THE DRAWINGS

The invention now will be described, by way of example only, and with reference to the accompanying drawings in which.

DETAILED DESCRIPTION OF THE DRAWINGS

Figure 1:
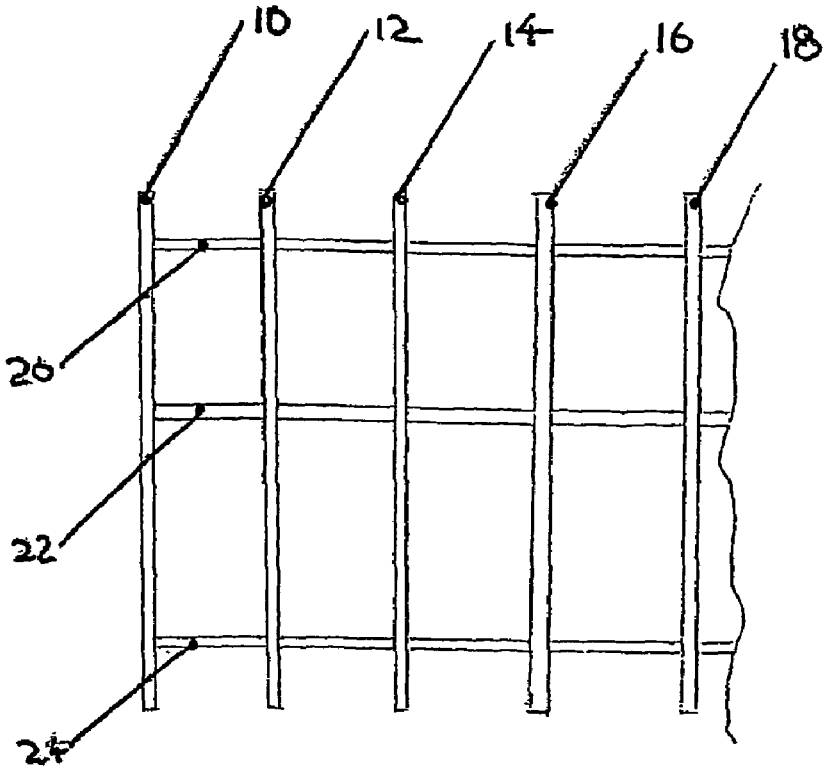
FIG. 1 shows a plan view of plurality of reinforcing rods connected together by flexible steel straps.

The following description and accompanying drawings attached to this specification are provided for the purpose of illustrating preferred embodiments of the present invention. It is to be understood that the invention should not be considered to be limited to the features described and disclosed in those drawings. Similar components between the embodiments are identified by the same reference numerals.

FIG. 1 shows a plan view of a plurality of reinforcing rods that are connected together by flexible steel straps. The plurality of reinforcing rods 10, 12, 14, 16, 18 are laid out such that they are generally parallel to each other and overlay a plurality of flexible steel straps 20, 22, 24. The reinforcing rods are tack welded to the flexible steel straps at the points where the two intersect. This is conveniently shown in FIG. 2 where the build up of weld metal 26 can be seen.

Figure 2:
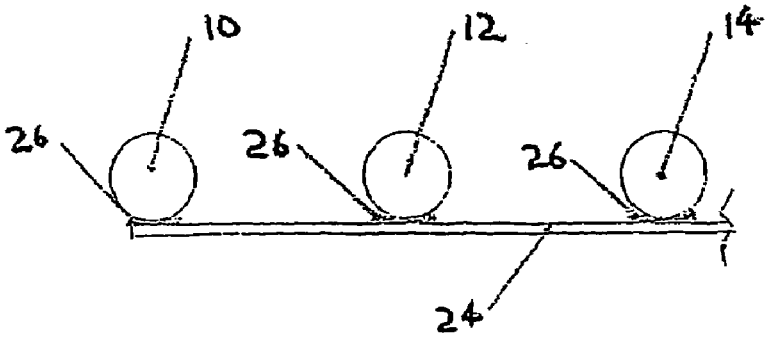
FIG. 2 shows a side view of the reinforcing rods FIG. 1.

The reinforcing rods and flexible connecting straps shown in FIGS. 1 and 2 can be wound up or rolled up into rolls for ease of transport and handling. Such rolls are commercially available and sold under the BAMTEC Trademark. BAMTEC is a registered trademark of Bam AG.

Figure 4:
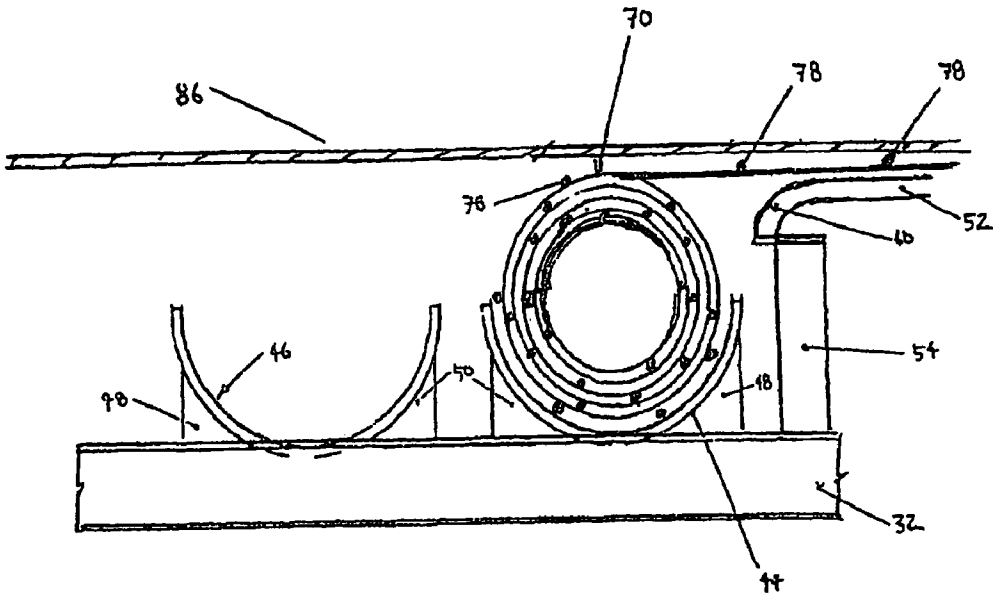
FIG. 4 shows an expanded view of the inset 3A depicted in FIG. 3.
Figure 3:
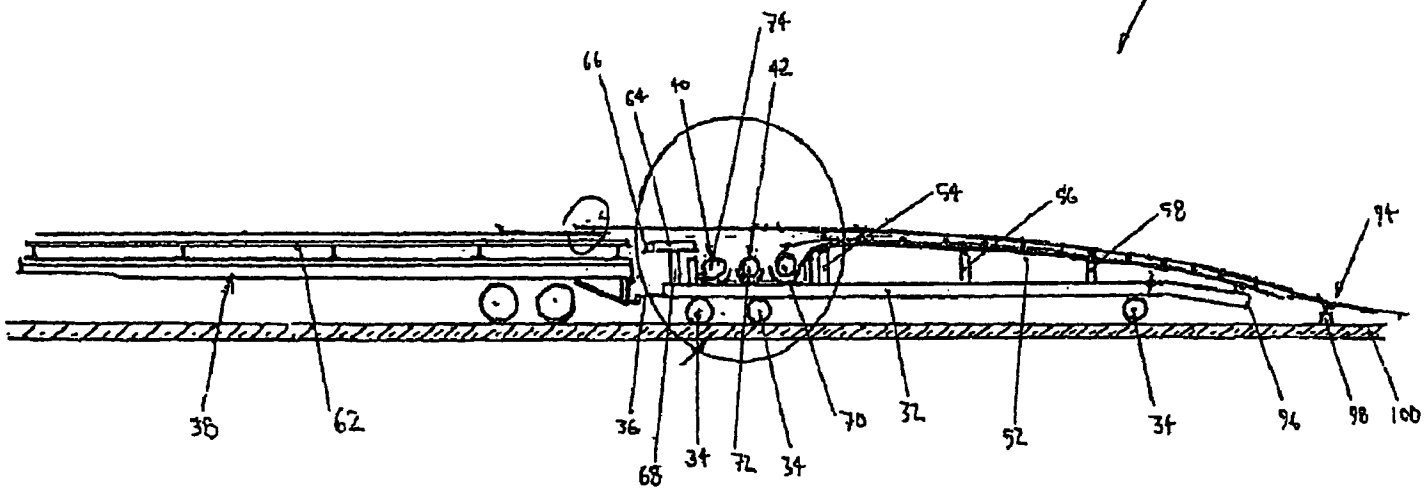
FIG. 3 shows a side view of an embodiment of a mobile workstation in accordance with the present invention.

A mobile workstation 30 in accordance with the second aspect of the present invention will now be described with reference to FIGS. 3, 4 and 5. In these Figures, the mobile workstation 30 has a chassis 32 that carries a number of wheels 34. The front wheels may be free-swivelling castor wheels. The rear wheels may also swivel, but they may be held at any selected swivel angles, for example, by means of trailing links extending from the wheel axis to a steering rod. In this regard, the wheels may be arranged in the same fashion as described in Australian Patent Number 752385.

The chassis 32 may comprise a steel frame having appropriate longitudinal members and transverse members. Again, the chassis may be as described with reference to Australian Patent Number 752385. The chassis 32 also includes a central tow hitch 36 to enable the mobile workstation 30 to be towed behind a truck 38. Thus, the mobile workstation 30 shown in FIGS. 3 to 5 is in the form of a towable trailer. However, it will be appreciated that the mobile workstation 30 of the present invention may also be in the form of a self-driven apparatus.

The chassis 32 carries three cradles 40, 42, 44. As shown in FIG. 4, cradle 44 includes a semi-circular trough 46 having a concave upper side. The semi-circular trough 46 extends substantially across the entire width of the mobile workstation 30. In order to stably mount the semi-circular trough 46 to the chassis 32, appropriate brackets 48, 50 are mounted to the chassis 32 and brackets 48, 50 support the semi-circular trough 46. It will be appreciated that brackets 48, 50 may extend across the width of the mobile workstation 30. Alternatively, a plurality of transversely spaced brackets 48, 50 may be mounted to the chassis 32 of the mobile workstation 30 in order to support the cradle 42.

The mobile workstation 30 further includes an apron 52. The apron 52 comprises a support surface that may include a plurality of longitudinal members and cross members connected together. The apron 52 is supported from the chassis 32 by posts 54, 56, 58. As can be seen from FIG. 3, posts 54, 56, 58 are of varying length and are sized such that the of the apron 52 slopes downwardly in a rearward direction.

The forward part of the apron 52 includes a downwardly turned edge 60 that provides a guide for the reinforcing rods. This will be described in more detail hereunder.

The truck 38 has a tray 62 that is sized to support a plurality of longitudinal reinforcing rods. These reinforcing rods may be separate rods that are not connected to each other. In this case, the mobile workstation preferably includes a longitudinal rod guide and spacing means, as described with reference to the mobile workstation described in Australian Patent Number 752385. Alternatively, and preferably, the longitudinal rods may be connected to each other by a plurality of flexible steel straps. In this regard, the longitudinal rods may be as described with reference to FIGS. 1 and 2. Most suitably, the longitudinal rods are supplied in the form of a roll of reinforcing rods. This will be described in more detail hereunder.

The mobile workstation 30 further includes a guide means 64 positioned in front of the cradles 40, 42, 44. The guide means 64 has a downwardly turned deflecting lip 66. The guide means 64 is supported on a post 68 connected to chassis 32. Guide means 64 is used to support the longitudinal rods as the pass rearwardly relative to the mobile workstation, over the cradles 40, 42, 44.

Operation of the mobile workstation 30 shown in FIGS. 3 to 5 will now be described. This will also explain preferred embodiments of the method in accordance with the first aspect of the present invention.

In order to operate the mobile workstation 30 in accordance with the present invention, a roll 70 of reinforcing rods is placed in cradle 44. Similarly, rolls 72, 74 are placed in respect of cradles 42, 40. As can be seen from FIG. 5, rolls 70, 72, 74 are positioned such that the reinforcing rods in the rolls lie transverse to the direction of travel of the mobile workstation. The direction of travel of the mobile workstation is shown by arrow 76 in FIG. 5.

At start up, a roll of transverse rods is unrolled such that it effectively covers the entirety of the apron 52 and extends a short distance past the rear end of the apron 52. A roll of longitudinal bars is then positioned over the rear most portion of the transverse bars. The row of longitudinal bars is then unrolled. The longitudinal reinforcing rods and transverse reinforcing rods are then tack welded together as a number of points to form a reinforcement mesh.

Figure 5:
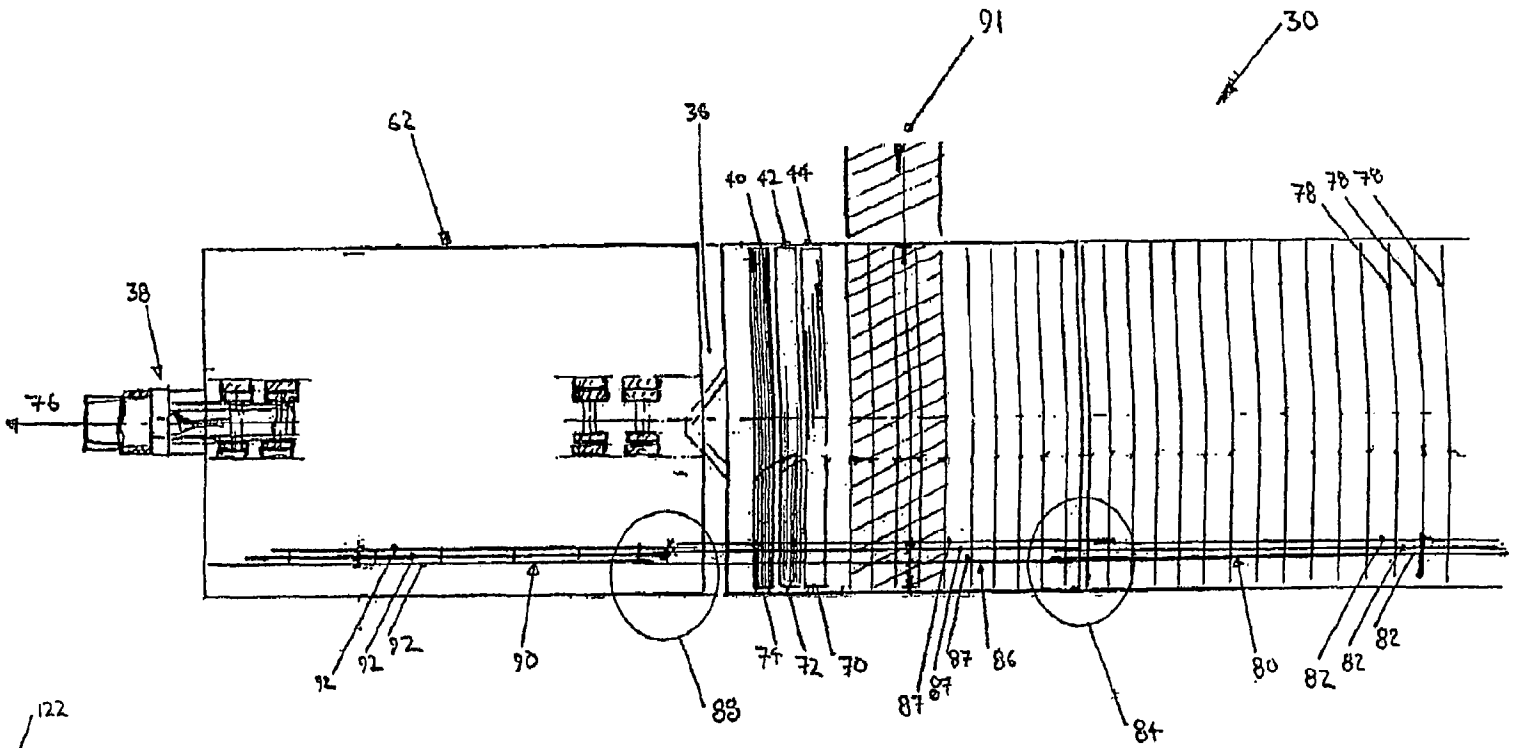
FIG. 5 shows a plan view of the mobile workstation depicted in FIG. 3.

With reference to FIG. 5, at start up roll 70 of transverse rods is unrolled such that a mat of transverse rods 78 connected to each other by flexible steel straps (in the fashion as shown with reference to FIGS. 1 and 2) extends over the apron and past the rear edge of the apron. A first roll 80 of longitudinal rods is positioned as shown in FIG. 5 allows one edge of the apron 52 and unrolled such that the longitudinal rods 82 extends substantially across the width of the transverse rods 78. In FIG. 5, only three longitudinal rods 82 are shown for the sake of clarity. The longitudinal and transverse rods are thus orthogonally aligned relative to each other. The longitudinal rods are spaced equally from each other and the transverse rods are spaced equally from each other. One or more of the transverse rods 78 are then tack welded to one or more of the longitudinal rods 82.

As can be seen from FIG. 5, longitudinal rod 82 have a length of approximately half the length of the apron 52. Therefore, longitudinal rod 82 terminate in the region shown by reference numeral 84. In order to assemble an essentially continuous reinforcement mesh, a second roll 86 of longitudinal rods is positioned such that one end of the longitudinal bars in roll 86 extends into area 84 such that the ends of longitudinal rods from roll 86 overlaps with the end of longitudinal rods 82. The area of overlap of the rods from the first roll of longitudinal rods 80 and the second row of longitudinal rods 86 may be joined together, for example by welding. The welding is preferably in the form of a lap joint. However, a butt joint may also be used. It will be appreciated that the second roll of longitudinal rods 86 is positioned and unrolled such that the longitudinal rods 86 extend across the length of the transverse rods 78 before the longitudinal rods in roll 86 are welded to the longitudinal rods 82.

As can be seen from FIG. 5, the longitudinal rods 87 from second roll 86 are sufficiently long so as to terminate in the area designated by reference numeral 88. In order to maintain an essentially continuous mesh of reinforcement, a further roll 90 of longitudinal rods 92 is positioned on the tray 62 of the truck 38. Again, connection between the longitudinal rods of roll 87 and the longitudinal rods 92 of roll 90 is achieved by means of an overlap welded joint or a butt welded joint.

Once the reinforcement mesh is formed by tack welding of the transverse rods 78 to the longitudinal bars 82 or 87, a reinforcement mesh 94 is formed and extends beyond the rear most portion 96 of apron 52. As the truck 38 moves forward in the direction of travel 76, the reinforcing mesh 94 is deposited onto spacers or chairs 98 that sit on a subsurface slab 100 of pavement under construction. It will be appreciated that subsurface slab 100 represents the surface on which the mobile workstation travels.

As the truck 38 slowly advances forward, the reinforcement mesh 94 is slowly deposited on the spacers or chairs 98. It will be appreciated that there is effectively no horizontal movement between the subsurface slab 100 and the longitudinal rods 82, 87, 92. However, as the mobile workstation 30 is moving in a forwardly direction, the longitudinal rods are effectively moving rearwardly relative to the mobile workstation. Once some of the transverse rods 78 have been tack welded to the longitudinal rods 82, the relatively rearwardly travel of the longitudinal rods relative to the mobile workstation 30 causes the roll 70 of transverse rods to unroll. Consequently, further transverse bars 78 become available for tack welding to the longitudinal rods in order to create further reinforcement mesh 94.

When the roll 70 of transverse rods has been exhausted, the second roll 72 of transverse rods is then used to be joined to the longitudinal rods that pass above it. Similarly, when second roll 72 of transverse rods is exhausted, third roll 74 of transverse rods is then used to join transverse rods to the longitudinal rods to continue making the reinforcement mesh 94.

Whilst this is taking place, cradles 42 and 44 may be supplied with fresh rolls of transverse reinforcing rods.

Once the start-up phase is completed, welding of the longitudinal rods to the transverse rods will typically take place in welding zone 91 of FIG. 5.

The tack welding between the longitudinal rods and transverse rods may be achieved by welding operators standing on or sitting above the mobile workstation 30. To this end, a platform or seating means may be provided on the mobile workstation 30. The platform or seating means may be supported by posts extending out from the lateral edges of the chassis 32. Alternatively, automated welding stations may be provided on the mobile workstation in order to form the tack welds between the longitudinal bars and transverse bars.

Figure 7:
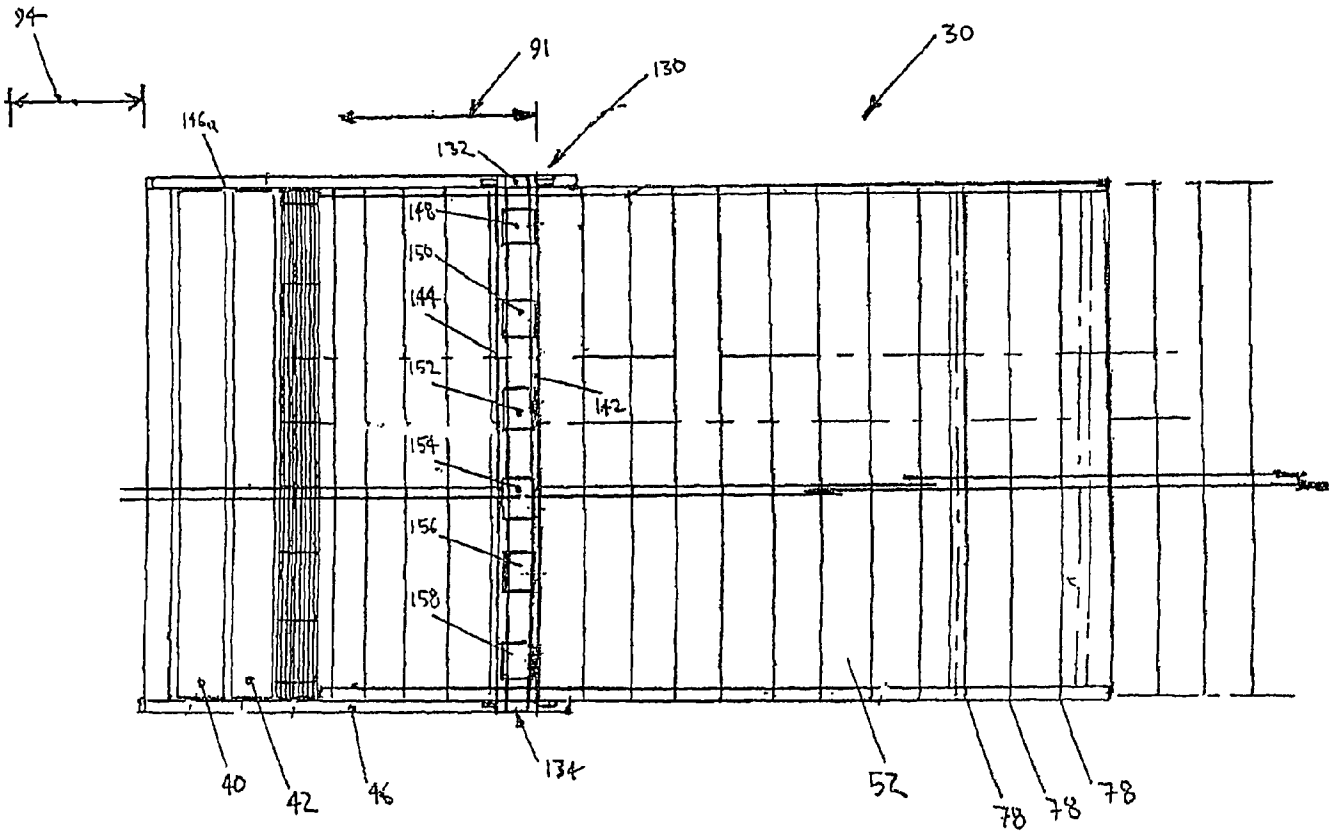
FIG. 7 shows a plan view showing the apparatus of FIGS. 3 to 6 with a mobile gantry in position.
Figure 8:
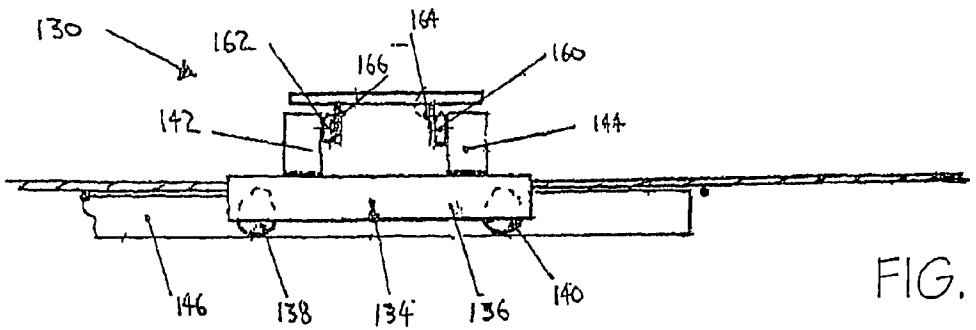
FIG. 8 shows a side view of the mobile gantry depicted in FIG. 7.

In an alternative embodiment shown in FIGS. 7 and 8, the apparatus is provided with a mobile gantry that can move across the region where welding takes place as described with reference to FIG. 5 in order to allow the welding of the longitudinal and transverse rods. The mobile gantry may be used to support a team of welders, in which case the welding is a manual welding operation. Alternatively, the mobile gantry may support one or more automatic welding heads.

The apparatus of includes a mobile gantry 130. The mobile gantry 130 includes respective side modules 132, 134. Side module 134 is shown in more detail in FIG. 8 comprising a side member 136 carrying wheels 138, 140. Wheels 138, 140 run along rail 146 mounted to the side of the apparatus 30. Other side module 132 has a similar arrangement of wheels running along a similar rail **146*a* mounted to the other side of the apparatus 30**.

Transverse members 142, 144 extend upwardly from side member 136 of side module 134 and across the width of the apparatus 30 to the other side module 132. Transverse members 142, 144 are positioned above the longitudinal and transverse rods during use of the apparatus. Transverse members 142, 144 support a plurality of movable seats 148, 150, 152, 154, 156, 158. FIG. 8 shows that seat 158 has wheels 160, 162 attached thereto by downwardly extending brackets 164, 166. Wheels 164, 166 can run on transverse members 142, 144, thus allowing seat 158 to move from side-to-side. Although FIG. 8 shows only 2 wheels attached to seat 158, it will be appreciated that more wheels, especially 4 wheels, may be attached to seat 158. The other seats have a similar arrangement.

Thus, the mobile gantry 130 allows welders to sit on the seats 148, 150, 152, 154, 156, 158 and to adjust their transverse and longitudinal position to allow welding in zone 92 and also in zone 94, which is the lap welding zone.

The mobile gantry may be provided with a motor to facilitate longitudinal movement of the gantry along rails 146, **146*a***. The mobile gantry may also be provided with automatic welding heads in place of the movable seats.

The method and apparatus of the present invention has a number of advantages over the apparatus and method described in Australian Patent No. 752385. In particular, the use of a roll of transverse rods connected to each other by flexible steel straps allows the roll of transverse rods to be unrolled or unwound once one or more of the transverse rods have been tack welded to the longitudinal rods. Accordingly, the roll of transverse rods unwinds at a rate that is governed by the rate of travel of the mobile workstation. The downturned lip 60 at the forward end of apron 52 ensures that the transverse rods 78 and their associated steel straps are guided onto the upper surface of the apron 52. Thus, the mat of transverse rods and connecting steel straps is automatically positioned onto the top surface of the apron such that tack welding to the longitudinal rods can be easily achieved. It is not necessary for operators to lift a large number of transverse rods into position for tack welding to the longitudinal rods, as was the case with the mobile workstation described in Australian Patent No. 752385.

As a further advantage, the cradles that hold the roll of transverse rods can be easily refilled with fresh rolls.

It is also preferred that the longitudinal rods are provided in the form of a roll of rods that is unrolled on the tray 62 of the truck 38. This enables rapid placement of the longitudinal rods onto the tray 62 of truck 38. It also can obviate the need for use of the longitudinal guiding and spacing means that is used on the mobile workstation described in Australian Patent No. 752385.

The method and apparatus of the present invention allows for increased productivity in the preparation of reinforcement meshes. The meshes can be quickly assembled and placed onto a surface.

Figure 6:
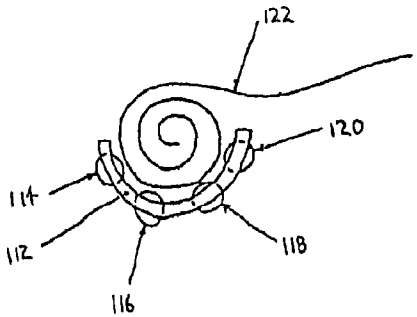
FIG. 6 shows a side view, in cross-section, showing an alternative cradle arrangement for use with the mobile workstation of FIGS. 3 to 5.

In an alternative construction for the cradles, as shown in FIG. 6, a cradle 110 includes a semi-circular trough member 112 fitted with four rotatable wheels or rollers 114, 116, 118, 120. The roll 122 of transverse rods rests upon the rotatable wheels or rollers 114, 116, 118, 120. Consequently, the unrolling of roll 122 is facilitated and enhanced.

Figure 9:
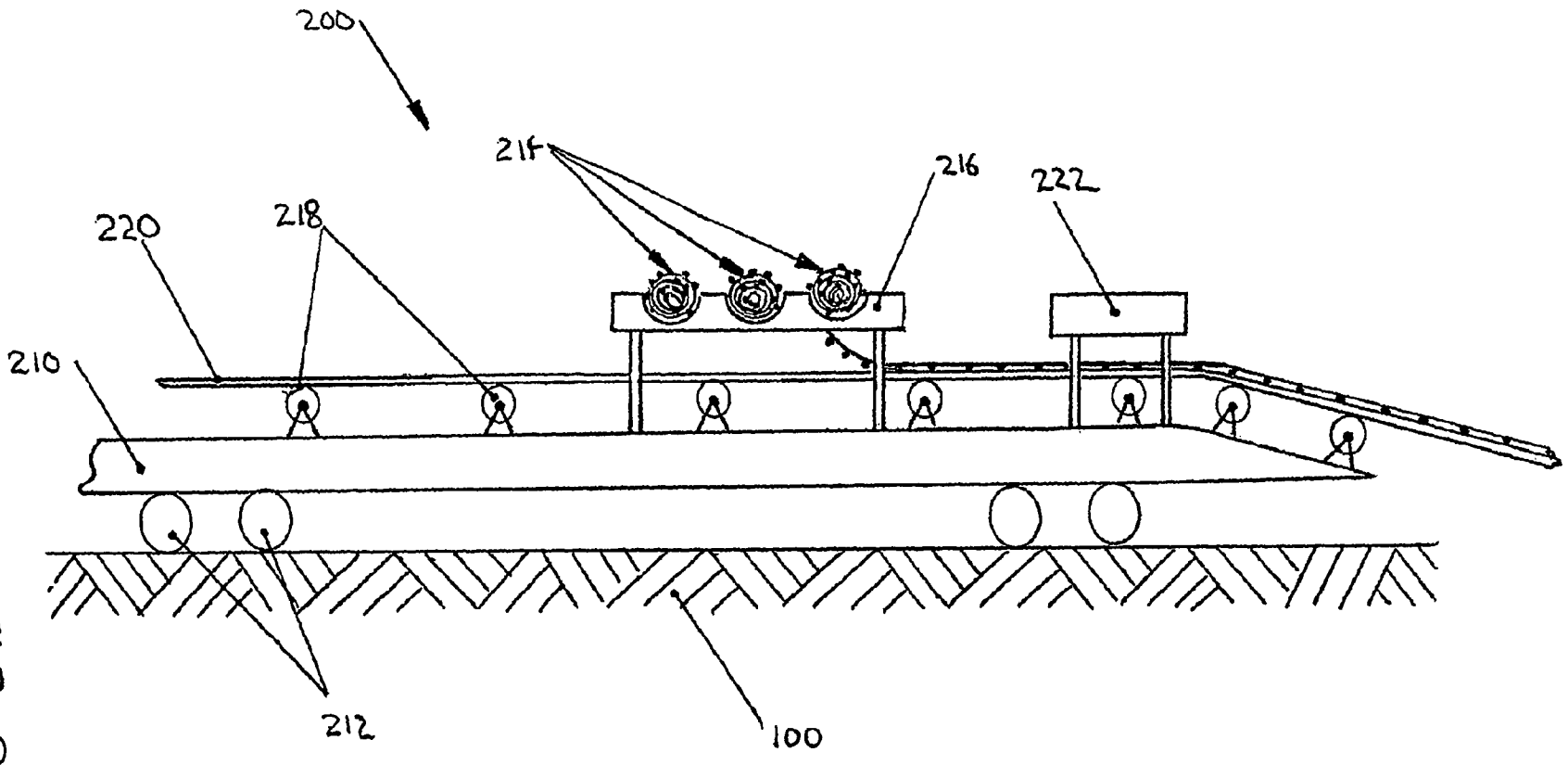
FIG. 9 shows a side view of a further embodiment of a mobile workstation according to the present invention.

FIG. 9 shows a further embodiment of a workstation 200 according to the present invention. The workstation includes an elevated support arrangement 210 supported on a prepared surface 100 by a plurality of wheels 212 so as to allow the workstation to move along the prepared surface 100. In this embodiment, three roll of transverse reinforcing rods 214 are provided and supported by a multi-roll support means 216 which is positioned above longitudinal reinforcing rods 220 and supported by the elevated support arrangement 210.

In this embodiment, the longitudinal reinforcing rods 214 are supported by a plurality of rollers 218. The rollers may extend across the width of the workstation 200, or optionally be individual discrete units. The rollers 218 may include a series of circumferential recesses or grooves so as to locate the longitudinal reinforcing rods 220 in position, guide the rods as they travel along the workstation and maintain the longitudinal reinforcing rods 214 in a spaced apart relationship.

In this embodiment, the transverse reinforcing rods 214 are depicted as being positioned above the longitudinal reinforcing rods 220 about midway along the workstation 200. It will be understood that the transverse reinforcing rods 214 may alternatively be located at other positions along the workstation 200. As shown, as the transverse reinforcing rods 214 unroll, the rods are positioned above the longitudinal reinforcing rods 220. A welding station 222 supported by a gantry is positioned above the transverse reinforcing rods 214 and the longitudinal reinforcing rods 220 and the transverse reinforcing rods 214 and the longitudinal reinforcing rods 220 are welded together so as to form a reinforcement mesh. The welding station is depicted as being located adjacent the end of the workstation 200 from which the mesh is deployed, although it is understood that the welding station 222 may be in fact position closer or adjacent to the multi-cradle support means 216.

The manner in which the reinforcement mesh is formed by the present embodiment and deployed is a similar manner as described with reference to the above embodiment and in the present invention as claimed. Again, it will be appreciated that the rods may be manually or automatically joined together to form the mesh.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

The invention claimed is:

1. A method for assembling and depositing a reinforcement mesh on a prepared surface comprising the steps of:

providing a mobile workstation which includes an elevated support arrangement, the workstation being moveable in a first direction;

positioning a series of longitudinal reinforcement rods on or above said support arrangement, said longitudinal reinforcement bars being spaced apart and aligned generally parallel to said first direction;

providing a roll of transverse reinforcing rods supported on said workstation and adapted to be unrolled to form a series of spaced apart reinforcement rods aligned generally transverse to said first direction;

connecting said transverse rods to at least one of said longitudinal rods to form an orthogonal reinforcement mesh on said mobile workstation; and moving the workstation in said first direction to deposit said mesh on said prepared surface.

2. A method according to claim 1, wherein the longitudinal reinforcing rods are provided in the form of a roll of rods connected together by flexible connecting elements, and the longitudinal reinforcing rods being arranged in spaced apart relationship by unrolling the roll.

3. A method according to claim 1, wherein said longitudinal reinforcing rods are maintained in said spaced apart relationship by a plurality of rollers on said elevated support arrangement.

4. A method according to claim 1, wherein the longitudinal reinforcing rods are supported on the support arrangement located to the fore of the roll of transverse reinforcing rods.

5. A method according to claim 1, wherein replacement longitudinal reinforcing rods are joined to the longitudinal rods which comprise the orthogonal mesh to thereby form a continuous orthogonal mesh on said prepared surface.

6. A method according to claim 5, further comprising the step of:

moving the workstation in said first direction a distance sufficient to draw at least a part of said mesh off said support arrangement to thereby create space on said support arrangement for said replacement longitudinal reinforcing rods; and positioning at least a second series of longitudinal reinforcing rods as the first series of longitudinal reinforcing rods moves in the second direction.

7. A method according to claim 5, further comprising the steps of:

providing a second roll of transverse reinforcing rods on the mobile workstation; and progressively joining the reinforcing rods of the second roll of transverse reinforcing rods to one or more of the longitudinal reinforcing rods as the longitudinal reinforcing rods travel over said support arrangement to thereby form a continuous reinforcement mesh.

8. A method according to claim 1, wherein the transverse reinforcing rods are joined to the longitudinal reinforcing rods by a welding process.

9. A method according to claim 8, wherein the welding process is effected manually.

10. A method according to claim 8, wherein the welding process is effected by an automated welding apparatus.

11. A method according to claim 1, wherein the transverse reinforcing rods are joined to the longitudinal reinforcing rods by a tying process using a wire, clamp or clip means.

12. A method according to claim 1, wherein the longitudinal and transverse reinforcing rods are sized such that the reinforcement mesh is suitable for reinforcing a concrete roadway.

13. A method according to claim 1, wherein the reinforcement mesh is deposited onto spacer members positioned on said prepared surface so as to maintain the reinforcement mesh spaced from the prepared surface at a suitable distance so as to allow the reinforcement mesh to be encased within a slab of concrete.

14. A mobile workstation for assembling and depositing a reinforcement mesh on a prepared surface, the workstation comprising:

an elevated support arrangement moveable along the prepared surface in a first direction;

at least one roll holding means for supporting a roll of transverse reinforcing rods, said roll adapted to unroll to form a series of spaced apart reinforcement rods aligned generally transverse to said first direction;

longitudinal reinforcement rod support means for supporting a series of longitudinal reinforcing rods, said series of longitudinal reinforcing rods being in a spaced apart relationship and generally parallel to said first direction;

wherein in use, said transverse rods are connected to at least one of said longitudinal rods to form an orthogonal reinforcement mesh and said workstation moves in said first direction to deposit said mesh on said prepared surface.

15. A mobile workstation according to claim 14, further comprising a chassis that is moveable along the prepared surface.

16. A mobile workstation according to claim 14, further comprising a plurality of wheels for allowing movement of the workstation along the prepared surface.

17. A mobile workstation according to claim 16, further comprising a set of caterpillar tracks for allowing movement of the workstation along the prepared surface.

18. A mobile workstation according to claim 14, further comprising an apron means extending rearwardly of the roll holding means and sloping downwardly toward the prepared surface on which the reinforcement mesh is to be deposited, so as to facilitate deployment of the reinforcement mesh to the prepared surface.

19. A mobile workstation according to claim 14, wherein the longitudinal reinforcing rod support means comprises a tray, wherein the tray is a portion of the mobile workstation.

20. A mobile workstation according to claim 14, wherein the longitudinal reinforcing rod support means comprises a plurality of rollers.

21. A mobile workstation according to claim 20, wherein the rollers include a circumferential recess, the recess being sized so as to locate the longitudinal reinforcing rods so as to maintain the longitudinal reinforcing rods in said spaced apart relationship.

22. A mobile workstation according to claim 14, wherein the workstation includes a drive means to motivate the workstation along the prepared surface.

23. A mobile workstation according to claim 14, wherein the workstation is motivated by an independent drive means, and the longitudinal rod support means comprises a tray which is integral with the independent drive means.

24. A mobile workstation according to claim 14, wherein the at least one roll holding means is positioned below a path of travel of the longitudinal reinforcing rods.

25. A mobile workstation according to claim 14, wherein the at least one roll holding means is positioned above a path of travel of the longitudinal reinforcing rods.

26. A mobile workstation according to claim 14, wherein the at least one roll holding means includes one or more rotatable elements on which the at least one roll is supported, the one or more rotatable elements facilitating unrolling of the rolls.

27. A mobile workstation according to claim 26, wherein the one or more rotatable elements comprises one or more wheel or roller members.

28. A mobile workstation according to claim 14, wherein the roll holding means comprises one or more cradles.

29. A mobile workstation according to claim 28, wherein the one or more cradles is semi-circular in section.

30. A mobile workstation according to claim 28, wherein the one or cradles extend across the mobile workstation.

31. A mobile workstation according to claim 28, wherein the one or more cradles is a plurality of narrow cradles positioned transverse relative to each other in a manner so as to support each roll.

* * * * *